US011725604B2

(12) United States Patent
Peavler et al.

(10) Patent No.: US 11,725,604 B2
(45) Date of Patent: Aug. 15, 2023

(54) METHOD FOR CONTROLLING PRESSURE WITH A DIRECT METERED PUMP BASED ON ENGINE SUBCYCLE MASS BALANCE

(71) Applicant: Cummins Inc., Columbus, IN (US)

(72) Inventors: Paul Peavler, Columbus, IN (US); Donald J. Benson, Columbus, IN (US); David Michael Carey, Greenwood, IN (US); Timothy J. Viola, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/630,466

(22) PCT Filed: Aug. 2, 2019

(86) PCT No.: PCT/US2019/044891
§ 371 (c)(1),
(2) Date: Jan. 26, 2022

(87) PCT Pub. No.: WO2021/025666
PCT Pub. Date: Feb. 11, 2021

(65) Prior Publication Data

US 2022/0252018 A1 Aug. 11, 2022

(51) Int. Cl.
*F02D 41/22* (2006.01)
*F02D 41/38* (2006.01)

(52) U.S. Cl.
CPC ..... *F02D 41/22* (2013.01); *F02D 41/3836* (2013.01); *F02D 41/3845* (2013.01); *F02D 2041/225* (2013.01); *F02D 2200/0602* (2013.01)

(58) Field of Classification Search
CPC .. F02D 41/22; F02D 41/3836; F02D 41/3845; F02D 2041/225; F02D 2200/0602
See application file for complete search history.

(56) References Cited

U.S. PATENT DOCUMENTS 7,287,515 B2 * 10/2007 Okamura ..... F02D 41/40 123/456
7,406,949 B1 8/2008 Puckett
(Continued)

FOREIGN PATENT DOCUMENTS

DE 10155249 4/2003

OTHER PUBLICATIONS

International Search Report and Written Opinion for International patent application No. PCT/US2019/044891, filed Aug. 2, 2019, dated Dec. 5, 2019.

(Continued)

*Primary Examiner* — George C Jin
(74) *Attorney, Agent, or Firm* — Taft, Stettinius & Hollister LLP

(57) ABSTRACT

The present disclosure relates to a method for controlling pressure of an engine, including a controller structured to implement the method and an engine system including the controller. More specifically, the present disclosure relates to a method based on a mass balance analysis of a fuel system to determine how much mass needs to be pumped to maintain or achieve a certain pressure for the engine. In some embodiments, the method analyzes how much mass can be pumped by each pumping event based on current engine conditions. The analysis is performed over the smallest repeatable pump events and cylinder events cycle, or "subcycle," based on the number of pump events and cylinder events for a given engine configuration.

15 Claims, 6 Drawing Sheets

(56) References Cited

U.S. PATENT DOCUMENTS

| | | | | |
|---|---|---|---|---|
| 7,690,353 | B2 | 4/2010 | Shafer et al. | |
| 7,823,566 | B2 | 11/2010 | Fox et al. | |
| 7,938,101 | B2 | 5/2011 | Cinpinski et al. | |
| 8,015,964 | B2 | 9/2011 | Eddy | |
| 8,136,508 | B2 | 3/2012 | Eddy | |
| 8,485,160 | B2 | 7/2013 | Li et al. | |
| 2003/0150426 | A1* | 8/2003 | Tanabe | F02M 63/0225 123/457 |
| 2005/0166900 | A1 | 8/2005 | Song | |
| 2006/0016429 | A1* | 1/2006 | Mashiki | F02M 63/0225 123/431 |
| 2006/0096579 | A1 | 5/2006 | Hayakawa | |
| 2008/0149081 | A1 | 6/2008 | Allain | |
| 2015/0240769 | A1* | 8/2015 | Zhang | F02M 59/367 123/456 |
| 2015/0240771 | A1* | 8/2015 | Pursifull | F02D 41/0025 73/114.41 |
| 2015/0300287 | A1* | 10/2015 | Ulrey | F02D 41/221 701/103 |
| 2015/0354483 | A1 | 12/2015 | Brewbaker et al. | |
| 2019/0178198 | A1* | 6/2019 | Okamura | F02M 59/10 |
| 2019/0211761 | A1* | 7/2019 | Ranga | F02D 41/1401 |

OTHER PUBLICATIONS

Extended European Search Report, Counter EP Application No. 19940352.8, dated Mar. 30, 2023, 10 pgs.

* cited by examiner

METHOD FOR CONTROLLING PRESSURE WITH A DIRECT METERED PUMP BASED ON ENGINE SUBCYCLE MASS BALANCE

CROSS -REFERENCE TO RELATED APPLICATIONS

This application is a national phase application of International Application No. PCT/US2019/044891, filed on Aug. 2, 2019, which is incorporated herein by reference in its entirety.

FIELD OF THE DISCLOSURE

The present disclosure generally relates to a method for controlling pressure within an engine and, more particularly, to a method for controlling pressure with a direct metered pump based on engine subcycle mass balance.

BACKGROUND OF THE DISCLOSURE

In typical engines, pressure control structures are designed with a focus on controlling the delivery of a high pressure pump or pumps to minimize the difference between the desired pressure level and the measured pressure level. Such a pressure focused control structure may rely on commanding each pumping event equally, which may result in suboptimal pump operation (e.g. efficiency, audible noise, pump drive system stress, pump durability, pump reliability, etc.) that is less responsive to a change in conditions. Improvements in the foregoing are desired.

SUMMARY OF THE DISCLOSURE

The present disclosure relates to a method for controlling pressure of an engine, including a controller structured to implement the method and an engine system including the controller. More specifically, the present disclosure relates to a method based on a mass balance analysis of a fuel system to determine how much mass needs to be pumped to maintain or achieve a certain pressure for the engine. In some embodiments, the method analyzes how much mass can be pumped by each pumping event based on current engine conditions. The analysis is performed over the smallest repeatable pump events and cylinder events cycle, or "subcycle," based on the number of pump events and cylinder events for a given engine configuration.

In an illustrative embodiment of the present disclosure, a method of controlling fuel pressure within an engine system is disclosed. The method comprises the steps of: providing an engine system comprising at least one pump, a controller, and an engine comprising at least one cylinder; calculating a ratio of cylinder events to pump events for an engine cycle to determine a minimum repeatable subcycle; performing a subcycle mass balance calculation on the engine system to calculate a total subcycle delivery demand of fuel; allocating the total subcycle delivery demand of fuel to each of the pump events; and delivering the fuel to the engine system.

The method may further comprise the steps of: receiving a pressure command value; measuring a pressure feedback value of the engine system; and calculating a pressure error value for use in the subcycle mass balance calculation. In such a method, the method may further comprise the steps of performing a second subcycle mass balance calculation on the engine system to calculate a second total subcycle delivery demand of fuel, wherein the second subcycle mass balance calculation includes the pressure error value; and allocating the second total subcycle delivery demand of fuel to each pump event. A method comprising the steps of receiving a pressure command value; measuring a pressure feedback value of the engine system; and calculating a pressure error value for use in the subcycle mass balance calculation may also further include the step of transmitting the pressure error value to a PID controller, wherein the PID controller applies a proportional integral derivative to the pressure error value and communicates a control signal for the subcycle mass balance calculation.

The method may further comprise the steps of: limiting the total subcycle delivery demand of fuel by a subcycle maximum delivery quantity of fuel; wherein a fuel amount corresponding to the subcycle maximum delivery quantity of fuel is delivered when the total subcycle delivery demand of fuel is greater than or equal to the subcycle maximum delivery quantity of fuel; and wherein a fuel amount corresponding to the total subcycle delivery demand is delivered when the total subcycle delivery demand of fuel is less than the subcycle maximum delivery quantity of fuel and greater than 0.

The step of delivering the fuel to the engine system may comprise delivering the fuel to a single cylinder. The subcycle mass balance calculation may include an integer of the cylinder events of the minimum repeatable subcycle, an engine fuel demand per cylinder, at least one mass effect, and a pressure error value. In such a calculation, the engine fuel demand per cylinder may be the amount of fuel needed by the engine system under current operating conditions divided by a number of engine cylinders in the engine system; the at least one mass effect may comprise leakage within the engine system; and the pressure error value may comprise the difference between a pressure feedback value from the engine system and a pressure command value.

In another illustrative embodiment of the present disclosure, a method of controlling fuel pressure within an engine system is disclosed. The method comprises the steps of: calculating a ratio of cylinder events to pump events for an engine cycle to determine a minimum repeatable subcycle; performing a subcycle mass balance calculation on the engine system to determine a total subcycle delivery demand of fuel; limiting the total subcycle delivery demand of fuel by a subcycle delivery quantity of fuel; allocating the total subcycle delivery demand of fuel or the subcycle delivery quantity of fuel to each pump event; delivering the fuel to the engine system; wherein delivering the fuel to the engine system includes delivering fuel to at least one pump of the engine system; measuring a pressure feedback value of the engine system; calculating a pressure error value from the measured pressure feedback value; and including the pressure error value in the subcycle mass balance calculation.

The step of limiting the total subcycle delivery demand of fuel by the subcycle maximum delivery quantity of fuel may comprise the steps of delivering the subcycle maximum delivery quantity of fuel when the total subcycle delivery demand of fuel is greater than or equal to the subcycle maximum delivery quantity of fuel; and delivering the total subcycle delivery demand of fuel when the total subcycle delivery demand of fuel is less than the subcycle maximum delivery quantity of fuel and greater than 0. The step of measuring the pressure feedback value of the engine system may comprise measuring the pressure feedback value in response to fuel delivery to at least one pump of the engine system.

The method may further comprise the steps of calculating a second subcycle mass balance that incorporates the pressure error value to determine a second total subcycle delivery demand of fuel; limiting the second total subcycle delivery demand of fuel by a subcycle delivery quantity of fuel; allocating the second total subcycle delivery demand of fuel or the subcycle delivery quantity of fuel to each pump event; and delivering the fuel to the engine system; wherein delivering the fuel to the engine system includes delivering fuel to at least one pump of the engine system. In such a method, the method may further comprise the steps of limiting the total subcycle delivery demand of fuel by a subcycle maximum delivery quantity of fuel; wherein a fuel amount corresponding to the subcycle maximum delivery quantity of fuel is delivered when the total subcycle delivery demand of fuel is greater than or equal to the subcycle maximum delivery quantity of fuel; and wherein a fuel amount corresponding to the total subcycle delivery demand of fuel is delievered when the total subcycle delivery demand of fuel is less than the subcycle maximum delivery quantity of fuel and greater than 0.

The subcycle mass balance calculation may include an integer of the cylinder events of the minimum repeatable subcycle, an engine fuel demand per cylinder, at least one mass effect, and a pressure error value. In such a method, the engine fuel demand per cylinder may be the amount of fuel needed by the engine system under current operating conditions divided by a number of engine cylidners in the engine system; the at least one mass effect may comprise leakage within the engine system; and the pressure error value may comprise the difference between a pressure feedback value from the engine system and a pressure command value.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

DETAILED DESCRIPTION OF THE EMBODIMENTS

Figure 1:
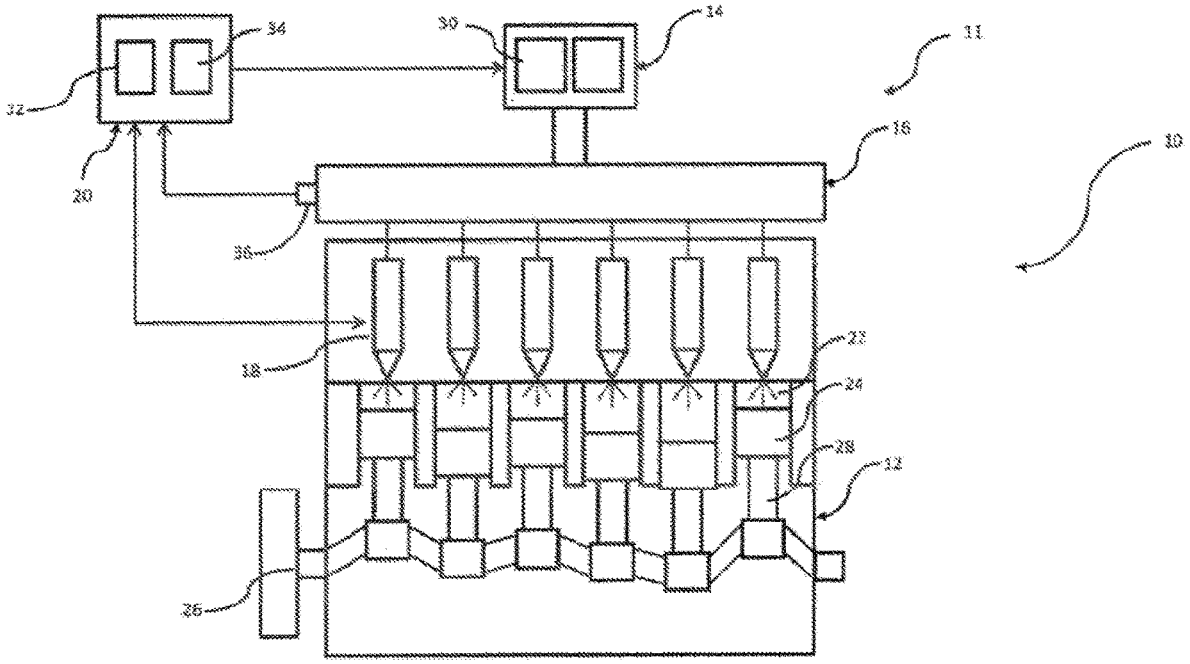
FIG. 1 is a conceptual drawing of an engine system, including a fueling system and an engine.

The embodiments disclosed herein are not intended to be exhaustive or to limit the disclosure to the precise forms disclosed in the following detailed description. Rather, the embodiments were chosen and described so that others skilled in the art may utilize their teachings.

The present disclosure relates to a control method for controlling pressure of an engine. In some embodiments, the pressure is controlled based on a mass balance analysis of the fuel system to determine how much mass needs to be pumped to maintain or achieve a certain pressure for the engine. In some embodiments, the method analyzes how much mass can be pumped by each pumping event based on current engine conditions. The analysis is performed over the smallest repeatable pump events and cylinder events cycle, or "subcycle," based on the number of pump events and cylinder events for a given engine configuration. For purposes of the present disclosure, a "pump event" is defined as the total cycle duration during which a single pumping element (for example, a single cylinder of a piston-cylinder pump) can deliver all of its swept volume of mass, i.e., the time from bottom dead center to top dead center in the case of a cam-driven piston-cylinder hydraulic fuel pump). A "cylinder event" comprises all injection events per cylinder in an engine cycle.

For example, if an engine is designed such that during a full engine cycle there are eight pump events and six cylinder injection events, and the fuel demand of the engine can exceed that required by a single pump event, the smallest repeatable cycle would be four pump events and three cylinder events. In such a case, the pressure control algorithm would attempt to balance the pressure by performing a mass balance analysis for this cycle of four pump events and three cylinder events rather than a full engine cycle of eight pump events and six cylinder events. Such an analysis allows the mass demand of the repeatable pump event and cylinder event cycle to be divided among the pumping events and allows for the method to assign pump commands to be sent to each pump event individually based on desired operating mode and system capabilities.

As used herein, the "mass balance calculation" refers to a calculation according Equation 1 below, in which the Total Subcycle Delivery Demand of Fuel is calculated:

Total Subcycle Delivery Demand of Fuel=(Integer of Cylinder Events from Ratio of Pump Events to Cylinder Events)*Engine Fuel Demand per Cylinder+Other Mass Effects+PID Control Output Equation 1:

As used herein, the "Total Subcycle Delivery Demand of Fuel" represents the amount of fuel that all of the pump events per subcycle need to cumulatively deliver to the rail to approach or maintain a target pressure.

The present disclosure provides various control methodologies for fuel pumps of various configurations to achieve different pump operation objectives, one of which is higher overall efficiency. More specifically, for pumps of varying physical configuration and driving mechanisms (e.g., gear coupling to a crankshaft), the control methodologies of the present disclosure permit customizing pump operation to achieve greater efficiency, less audible noise, less vibration, less harshness, greater pump reliability, greater pump life cycle, more constant overall accumulator fuel pressure, and/or more constant fuel pressure during fuel injection events. Depending upon the operating conditions of the pump, a weighted or unweighted combination of these objectives may be achieved.

Certain operations described herein include evaluating one or more parameters. "Evaluating," as utilized herein, includes, but is not limited to, receiving values by any method known in the art, including at least receiving values from a datalink or network communication, receiving an electronic signal (e.g., a voltage, frequency, current, or PWM signal) indicative of the value, receiving a software parameter indicative of the value, reading the value from a memory location on a computer readable medium, receiving the values as a run-time parameter by any means known in the art, by receiving a value by which the interpreted parameter can be calculated, and/or by referencing a default value that is interpreted to be the parameter value.

Referring now to FIG. 1, an engine system 10 includes a fueling system 11 and an engine 12. The fueling system 11 generally includes a fuel pump 14, a common rail fuel accumulator 16, a plurality of fuel injectors 18, and a controller 20. The engine 12 generally includes a plurality of cylinders 22 in which a plurality of pistons 24 reciprocate under power provided by fuel combustion, thereby causing a crankshaft 26 to rotate via a corresponding plurality of connecting rods 28. The fuel pump 14, which is depicted in this example as having two pumping elements 30, receives fuel from a fuel source (not shown), pressurizes the fuel, and provides the pressurized fuel to accumulator 16. The plurality of fuel injectors 18, which are coupled to and receive fuel from the accumulator 16 under control of the controller 20, deliver fuel to cylinders 22 at specified times during the engine cycle, as is well known in the art.

The highly simplified figure of the controller 20 shown in FIG. 1 includes a processor 32 and a non-transitory memory 34, wherein the memory 34 stores instructions and other necessary information regarding the operation of the controller 20 and the engine system 12, while the processor 32 executes said instructions. The controller 20 is substantially more complex than is shown, and may include multiple processors and memory devices, as well as a plurality of other electronic components. Illustratively, the controller 20 receives pressure measurements 136 (FIG. 4) from a pressure sensor 36 coupled to the accumulator 16. In another embodiment, the pressure sensor 36 is located in any part of the pressurized fuel system and may be located after the outlet of the pump, in the fuel lines, or in the fuel injectors. The pressure measurements 136 indicate the pressure of fuel in the accumulator 16, and the controller 20 controls operation of the pump 14 in response to the pressure measurements 136. More specifically, the controller 20 independently controls the delivered pumping quantity output of each potential high pressure pumping event of each pumping element 30. This ability permits the controller 20 to operate the pump 14 in different control modes based on the instantaneous operational state of the pump and the system to improve performance with respect to desired outputs such as fuel economy, fuel efficiency, audible noise, pump drive system stress, pump durability, pump reliability, and pressure variation.

Figure 2:
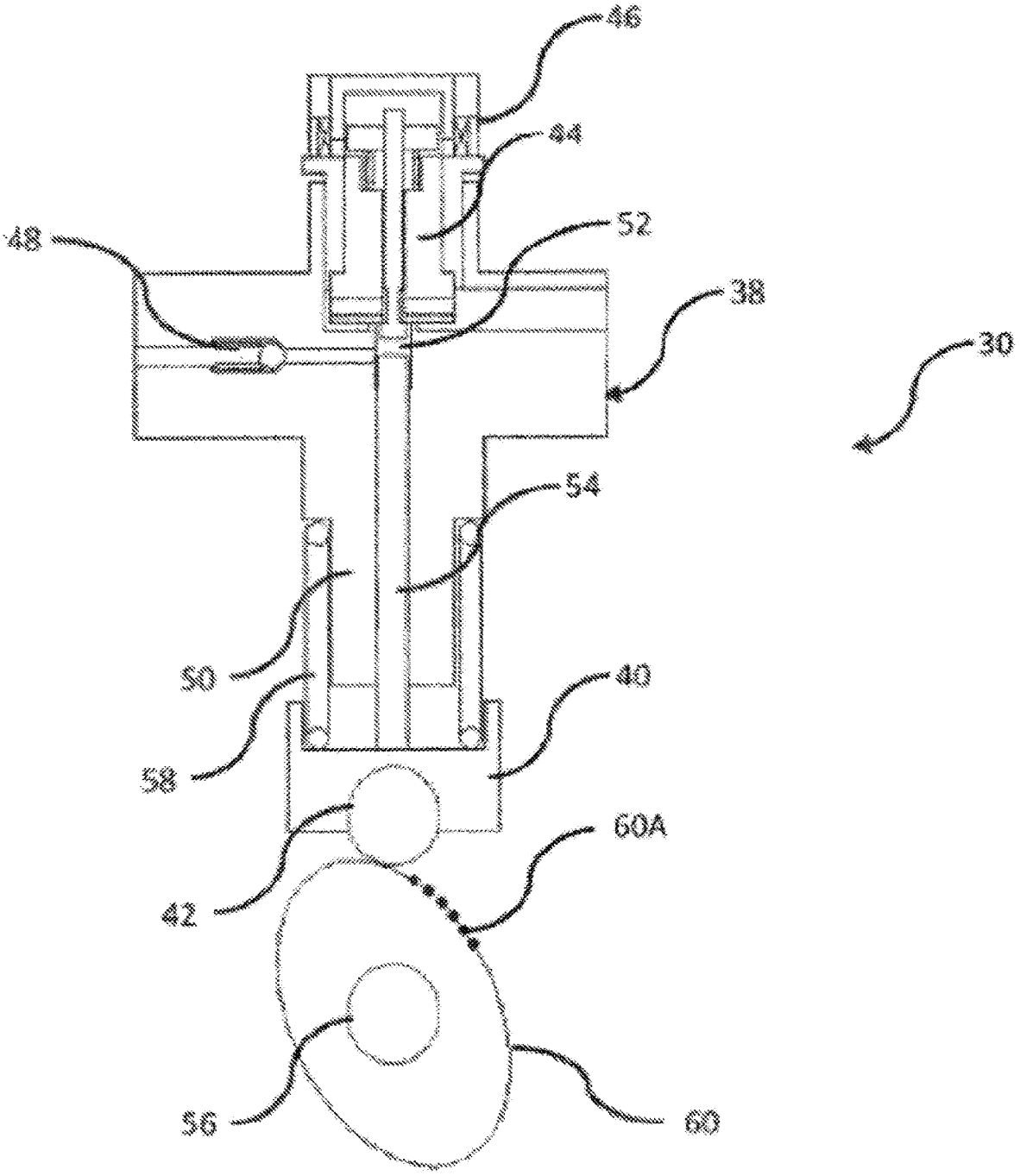
FIG. 2 is a cross-sectional side view of a pumping element of the fueling system of FIG. 1.

Now referring to FIG. 2, an illustrative pumping element 30 is shown in greater detail. The pumping element 30 generally includes a housing 38, a tappet 40, and a roller 42. An inlet valve 44 controlled by a solenoid 46 is disposed at an upper end of the housing 38. An outlet valve 48 is also disposed in the housing 38. The housing 38 includes a barrel 50, which defines a pumping chamber 52. A plunger 54 coupled to the tappet 40 reciprocates in the pumping chamber 52, compressing any fuel in the pumping chamber 52 during upward pumping strokes for delivery to the outlet valve 48, and, from there, to the accumulator 16. In another embodiment, the plunger 54 is not coupled to the tappet 40. Fuel may be delivered to the pumping chamber 52 by the inlet valve 44 during downward filling strokes.

Reciprocal motion of the plunger 54 is powered by rotational motion of a camshaft 56 coupled to the crankshaft 26 (FIG. 1) and a downward biasing force of a return spring 58. As the camshaft 56 rotates, an eccentric lobe 60 mounted to the camshaft 56 also rotates. The roller 42 remains in contact with the lobe 60 as a result of the biasing force of the spring 58. Accordingly, during half of a revolution of the camshaft 56, the lobe 60 pushes the roller 42 upwardly, along with the tappet 40 and the plunger 54. During the other half of the revolution of the camshaft 56, the spring 58 pushes the roller 42 downwardly into contact with the lobe 60, along with the tappet 40 and the plunger 54. Toggling the operational state (e.g., open or closed) of the inlet valve 44 is controlled by the controller 20 to cause the pumping element 30 to deliver quantities of fuel to the accumulator 16 according to the various control methodologies described below.

Figure 3:
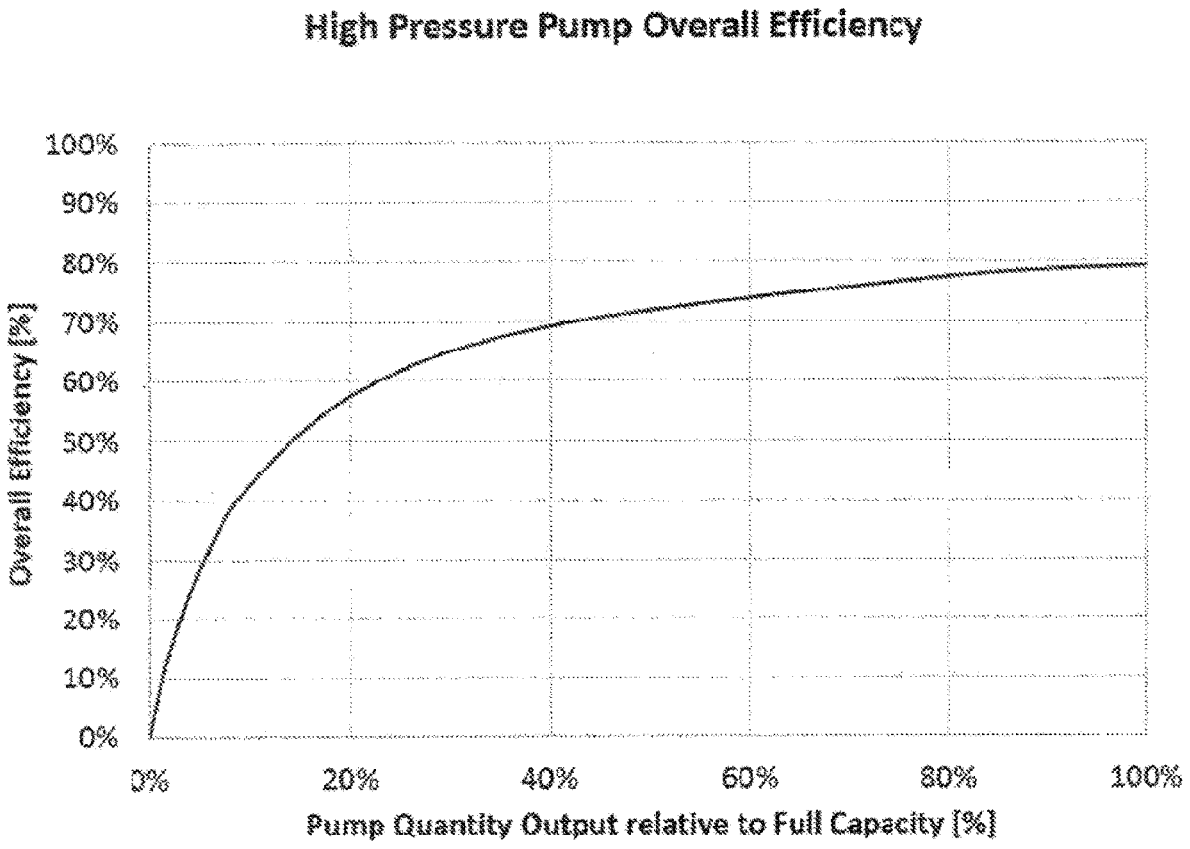
FIG. 3 is a graph of results of a prior art control methodology for a pumping configuration.

Pumps of all kinds have efficiency profiles which indicate the relationship of the energy efficiency of the pump relative to the output of the pump. Referring to FIG. 3, a typical efficiency profile for a high pressure fuel pump, such as the pump 14 of FIG. 1, is depicted. As shown, the pump achieves its highest overall efficiency (approximately 80%) when delivering a pumped quantity that equals 100% of its pumping capacity. As is known in the art, fixed energy losses always exist that prevent any pump from achieving 100% efficiency. For pumped quantities below 40%, and especially below 20%, the overall efficiency of the pump rapidly decreases. This example profile simply provides an illustration of the known principle that fuel pumps operate at higher efficiencies when operating at maximum pumping capacity. This principle is used to achieve higher efficiency pump operation in a plurality of the control methodologies according to the present disclosure.

In a conventional fuel pump control methodology, the controller 20 receives accumulator fuel pressure feedback from the pressure sensor 36 and controls the operation of the pump 14 so that a desired average pressure in the accumulator 16 is achieved and maintained. When the pressure measured by the pressure sensor 36 is low, the controller 20 commands operation of the pump 14 in such a way that more, higher pressure fuel is provided to the accumulator 16. In a steady-state, time averaged operating condition, the pump 14 provides the same amount of fuel to the accumulator 16 as the injectors 18 remove from the accumulator 16 to deliver to the cylinders 22.

Additionally, in fueling system 11, the pump must have a delivery capacity that is greater than will be required under the steady-state operating conditions of engine 12. Under certain operating conditions, generally transient, the engine 12 will require a maximum amount of fuel. In such conditions, the pump must be sized to deliver that quantity of fuel plus an additional margin (e.g., 15%, 20%, etc.) to account for other variables in the system. Additionally, fuel pumps may experience leakage under certain operating temperatures. Thus, fuel pumps are by necessity "over-designed." As a result, typical fuel pumps rarely operate at full capacity, which, as is shown in FIG. 3, results in undesirable efficiency.

The above-mentioned control methodologies may be viewed as having one or more of the following features: (1) binary pumping; (2) phased pumping; (3) gentle pumping; and (4) pumping to minimize injection pressure variations. Binary pumping denotes operating each of the pumping elements 30 during each pumping event in a binary or digital manner, such that the pumping element 30 outputs fuel at 100% of its capacity or 0% of its capacity. Phased pumping denotes operating the pumping elements 30 to provide fuel delivery pumping events that are preferentially timed relative to the phasing of the cylinder events of the fuel injectors 18. Gentle pumping denotes operating the pumping elements 30 in a manner that causes the accumulator 16 to have the same or substantially the same fuel pressure at the start of or during each cylinder event of the fuel injectors 18.

Figure 4:
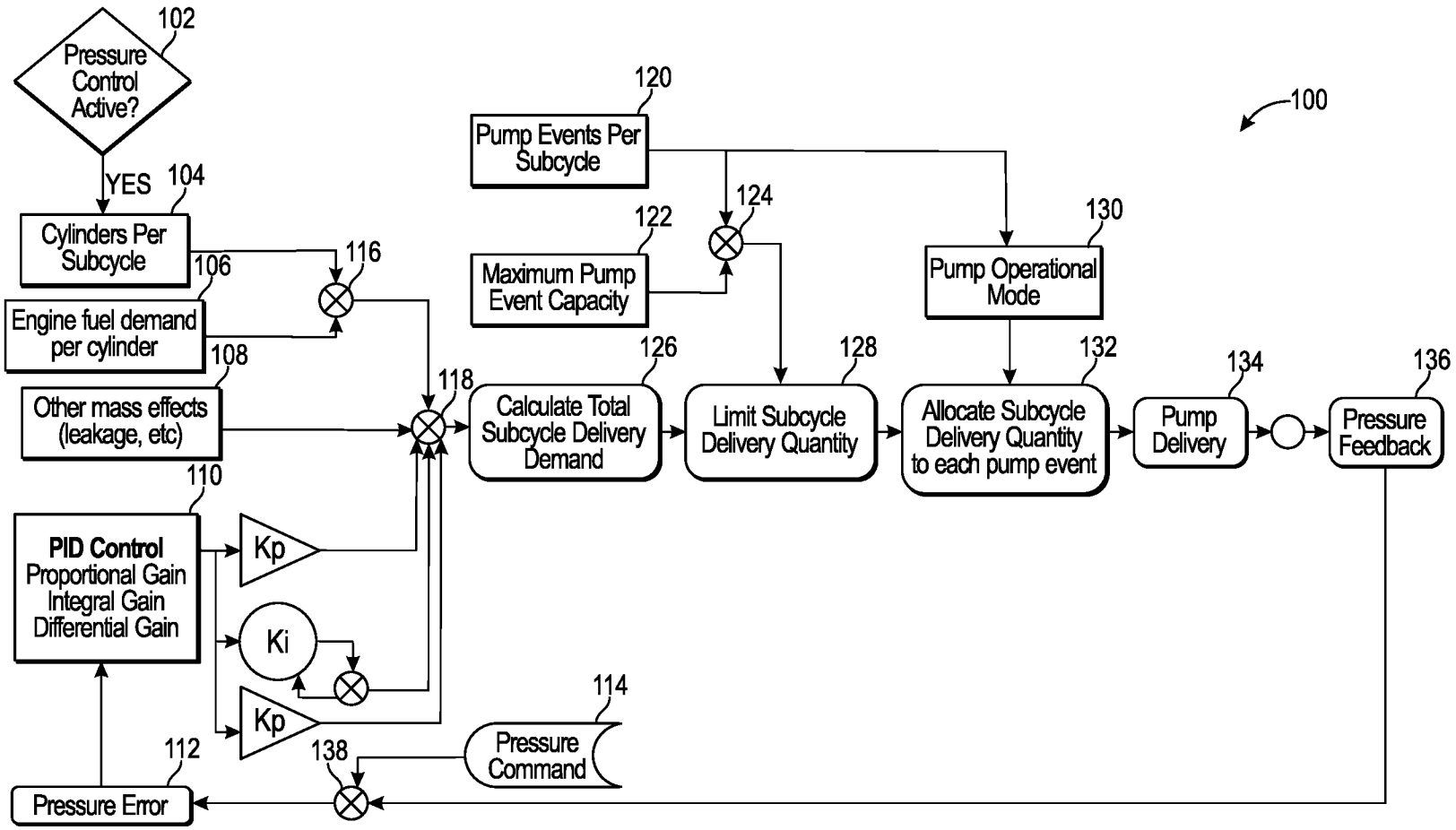
FIG. 4 is a flowchart illustrating the method of pump control in accordance with the present disclosure.
Figure 6:
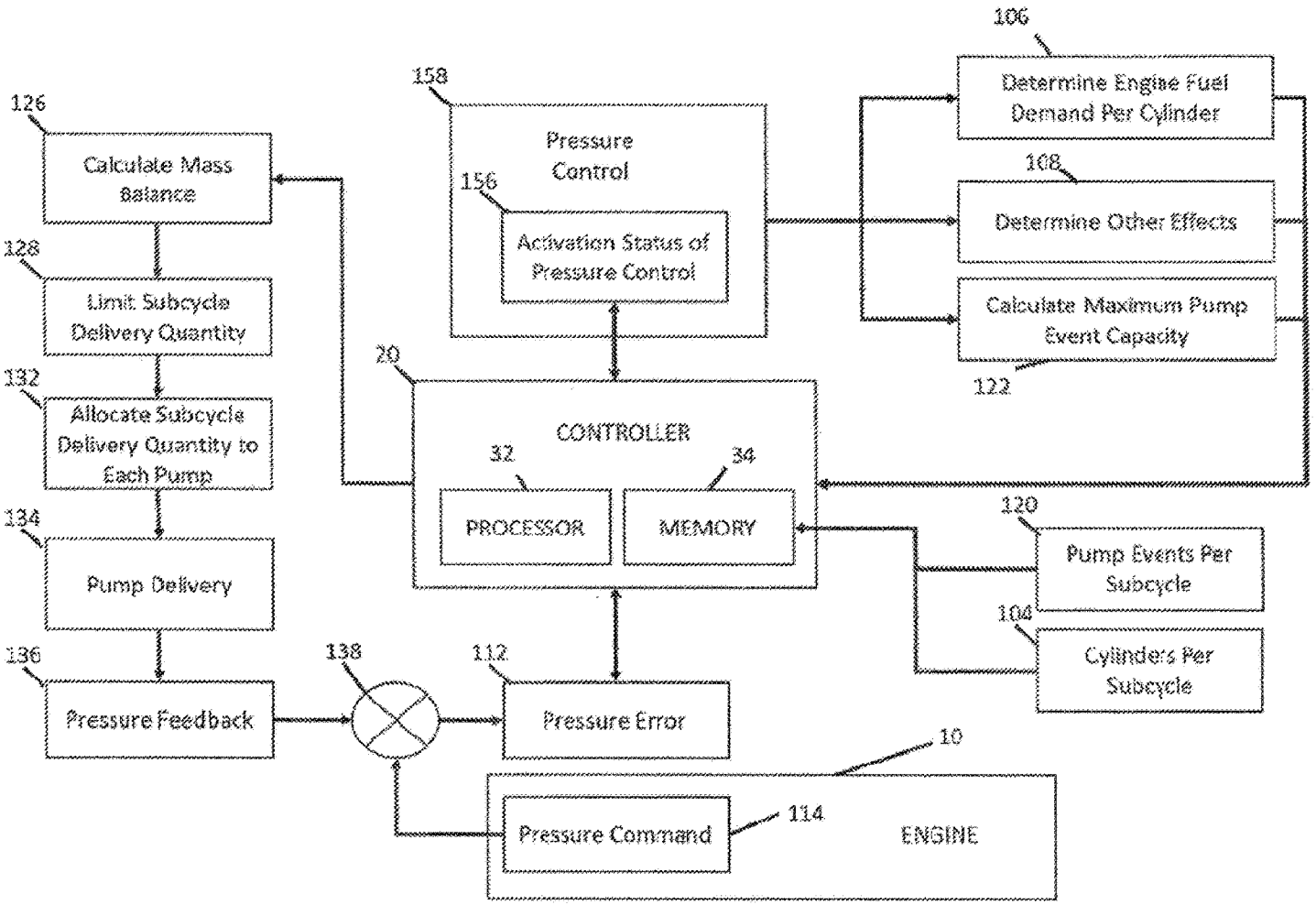
FIG. 6 is a block diagram illustrating a control system for the pump control method of FIG. 4.

FIGS. 4 and 6 illustrate the functionality of the controller 20 of the engine system 12 within the method 100. In addition to the processor 32 and the memory 34, the controller 20 has modules structured to functionally execute operations for managing operation of the engine system 10.

In certain embodiments, the controller 20 forms a portion of a processing subsystem, including one or more computing devices having memory, processing, and communication hardware. The controller 20 may be comprised of a single device or a distributed device, and the functions of the controller 20 may be performed by hardware and/or software. In certain embodiments, the controller 20 includes one or more modules structured to functionally execute the operations of the controller 20. In certain embodiments, the controller 20 may alter the operation of the engine system 10 in response to a pressure feedback value 136 and a pressure command value 114 of the engine system 10.

The controller 20 is in electrical communication with the engine 12, such that the controller 20 monitors the pressure within the engine 12 via a pressure control 158. Initially, during operation of the engine 12, the controller 20 toggles an activation status 156 of the pressure control 158 so that the pressure control 158 is activated. Once activated, the pressure control 158 determines a pressure error value 112 from the pressure feedback value 136 of the engine 12 and the pressure command value 114 of the engine 12, which is then sent to controller 20. The controller 20 also initiates internal subroutines for determining an engine fuel demand per cylinder 106, other mass effects 108, and a maximum pump event capacity 122. The controller 20 also retrieves internally stored values of the engine system 10 such as pump events per subcycle 120 and cylinder or cylinder events per subcycle 104 from the memory 34. The controller then calculates a mass balance 126 to determine the fuel delivery quantity for the engine subcycle and performs additional functions described further herein before delivering the fuel quantity to a pump 134. After delivery, the controller 20 receives a new pressure error 112 from the pressure feedback value 136 generated from the fuel delivery and the pressure command value 114 from the engine 12. The above-described process is then repeated until the engine 12 is in an inactive or off state, and the pressure control 158 is toggled to an inactive or off state.

Referring now primarily to FIG. 4, a method 100 for controlling engine pressure is shown. In particular, the method 100 provides a method for controlling pressure with a direct metered pump. The method 100 uses an engine subcycle mass balance to control pressure within individual cylinders. In this way, individual cylinders can be responsive to changes in operation of the engine system 10 (FIG. 1) within the engine cycle, rather than waiting for the next full engine cycle.

The method 100 begins at block 102, wherein the controller 20 determines whether a pressure control 158 (FIG. 6) of the engine system 10 is active. If the pressure control 158 is active, the controller 20 retrieves the number of cylinder or cylinder events per subcycle 104 from the memory 34 and communicates the value to a unit 116. The controller 20 also retrieves the number of pump events per subcycle 120 from the memory 34 and communicates the value to a unit 124 for aggregation with a maximum pump event capacity 122.

Figure 5:
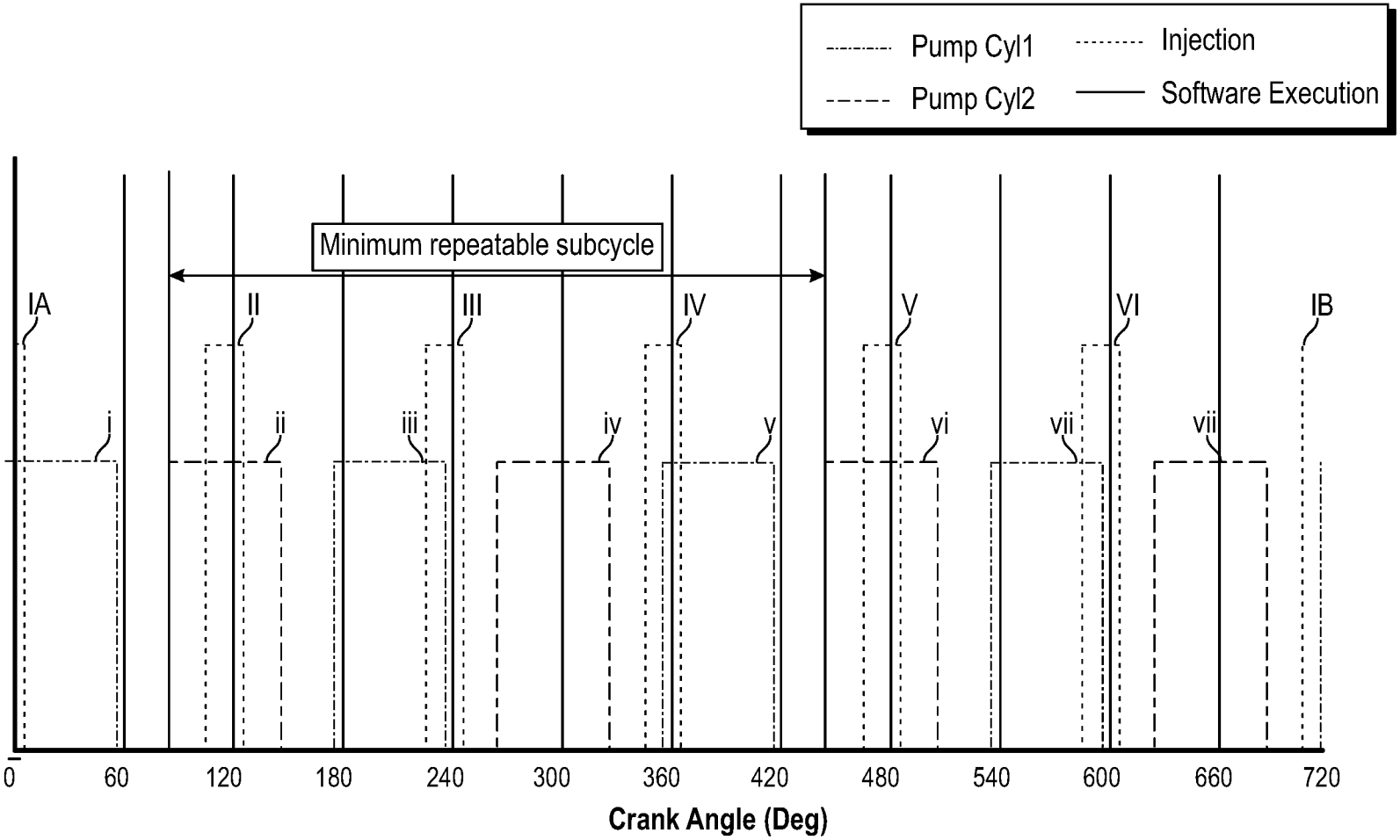
FIG. 5 is a graph illustrating the application of the method of FIG. 4 in accordance with the present disclosure.

Referring to FIG. 5, exemplary pump event and cylinder event data are shown to determine the values of the cylinder or cylinder events per subcycle 104 and pump events per subcycle 120 (FIGS. 4, 6). That is, the subcycle for a given engine configuration can be determined from the exemplary data for engine system 10. As shown in FIG. 5, engine system 10 (FIG. 1) is designed such that a full engine cycle encompasses the angle duration of a full engine cycle (e.g., 720 degrees for a 4-cycle engine or 360 degrees for a 2-cycle engine) of crankshaft 26 (FIG. 1) rotation or two full revolutions. It is within the scope of the present disclosure that a full engine cycle can be defined differently for other engine systems. During the full engine cycle shown in FIG. 5, there are eight pump events i-viii and six cylinder events (IA, IB, II, III, IV, V, and VI). Events IA and IB each constitute half of a cylinder event. From this information, the smallest or minimum repeatable subcycle comprises four pump events and three cylinder events. Stated another way, the number of pump events per subcycle is four pump events, and the number of cylinder events per subcycle is three cylinder events.

From the subcycle determination of FIG. 5, the method 100 controlled by the pressure control algorithm balances the pressure for engine system 10 by performing a mass balance analysis by the subcycle rather than the full engine cycle, or a more general mass balance analysis (e.g., "flow in minus flow out" analysis). This allows the calculated mass demand of the subcycle to be easily divided among the pumping events. This division can be commanded at some other point in software of the engine system 10 and allows for granular control of the engine system 10 that is responsive to changes in the engine system 10 (e.g., engine acceleration, deceleration, etc.).

Referring again to FIG. 4, the controller 20 also performs internal subroutine calculations to determine an engine fuel demand per cylinder 106, other mass effects 108 (e.g., leakage), and a maximum pump event capacity 122. The engine fuel demand per cylinder 106 can be calculated by dividing the amount of fuel needed by the engine system 10 under current operating conditions by the number of cylinders 22 within the engine 12. Once the engine fuel demand per cylinder 106 is calculated, the value is communicated to the unit 116. The aggregation of the value of the engine fuel demand per cylinder 106 and the value of cylinder or cylinder events per subcycle 104 is communicated to a unit 118, which also receives the values for other mass effects 108. In one embodiment, the mass effects 108 may include leakage from a rail, a pump, a pressure release valve, or other components.

The pressure error value 112 is first communicated to a proportional integral derivative (PID) controller 110 before being transmitted to the unit 118. it is contemplated that in other embodiments, other suitable controllers may be used, such as a proportional (P) controller or a proportional-integral (PI) controller, for example. Alternative controller methods include, for example, full state feedback control. The pressure error value 112 is calculated from the difference between the pressure command value 114 received from the engine system 10 and a measured pressure feedback value 136 of the engine system 10. The pressure command value 114 represents the desired pressure for the engine system 10 while the pressure feedback value 136 represents the pressure of the engine system 10 during operation. The pressure command value 114 and the pressure feedback value 136 are communicated to the unit 138, where the pressure error value 112 is calculated and communicated to the PID controller 110.

Once the PID controller 110 receives the pressure error value 112, the PID controller applies the proportional integral derivative to the pressure error value 112 and communicates a control signal to the unit 118 for calculation of the Total Subcycle Delivery Demand of Fuel by Equation 1 described above.

The controller 20 limits the total subcycle delivery demand of fuel by the subcycle maximum delivery quantity of fuel determined at a block 128. That is, the subcycle maximum delivery quantity of fuel 128 is an upper limit on the total subcycle delivery demand of fuel 126. The subcycle maximum delivery quantity of fuel 128 incorporates the information received from the unit 124, which includes the aggregation of the pump events per subcycle 120 and the maximum pump event capacity 122. The maximum pump event capacity 122 can be determined for each of the individual pumping elements of the engine system 10. In one embodiment, the maximum pump event capacity 122 is a value that can be found in a stored data table of an electronic control module (ECM) taking into account the engine speed or pump pressure. In another embodiment, the pump event maximum capacity can be a real-time calculation based on various engine conditions, such as engine speed or pump pressure.

As mentioned above, the subcycle maximum delivery quantity of fuel 128 functions as an upper limit of the total subcycle delivery demand of fuel 126. For example, the subcycle maximum delivery quantity of fuel 128 constrains the total subcycle delivery demand of fuel 126 to a value between 0 and the maximum delivery quantity of fuel available. If the total subcycle delivery demand of fuel 126 is greater than or equal to the subcycle maximum delivery quantity of fuel 128, then a fuel amount corresponding to the subcycle maximum delivery quantity of fuel 128 is delivered from the pump 14 to the rail 16. The injectors 18 then pull the fuel from the rail 16 and deliver the fuel to the cylinders 22 of the engine 12. If the total subcycle delivery demand of fuel 126 is less than or equal to zero, then no fuel is delivered from the pump 14 to the rail 16. However, the injectors 18 may still deliver fuel to the cylinders 22 of the engine 12. Such an event may occur, for example, during a low pressure transient condition wherein the pump demand may be equal to zero, but the injectors 18 continue to function. If the total subcycle delivery demand of fuel 126 is less than the subcycle maximum delivery quantity of fuel 128, then a fuel amount corresponding to the total subcycle delivery demand of fuel 126 is delivered to the cylinders 22 of the engine 12 via the same pathway described above.

The controller 20 then allocates either the subcycle maximum delivery quantity of fuel 128 or the total subcycle delivery demand of fuel 126 to each pump event of the subcycle. The allocation of fuel depends on the pump events per subcycle 120 and the mode of pump operation 130. That is, once the total subcycle delivery demand of fuel 126 is limited based on the subcycle maximum delivery quantity of fuel 128, the total subcycle delivery demand of fuel 126 of Equation 1 or the subcycle maximum delivery quantity of fuel 128 is divided by the number of pump events per subcycle 120. The mode of pump operation 130 includes determining which pump events of the engine subcycle are active according to the control mode of the engine 12. That is, the controller 20 can operate the pump 14 in different control modes based on the instantaneous operational state of the pump 14 and the engine 12 to improve performance with respect to desired outputs, such as fuel economy, fuel efficiency, audible noise, pump drive system stress, pump durability, pump reliability, and pressure variation.

In one embodiment, the allocation of the subcycle delivery quantity of fuel 132 is equal among the pump events of the subcycle. It is contemplated, however, that in other embodiments, the allocation of the subcycle delivery quantity of fuel varies among the pump events of the subcycle. Further description of the various allocation methods of the subcycle delivery quantity of fuel among the pump events of the subcycle is provided in PCT Application No. PCT/US2017/058078, filed Oct. 24, 2017, and entitled FUEL PUMP PRESSURE CONTROL STRUCTURE AND METHODOLOGY, the disclosure of which is hereby incorporated by reference in its entirety.

The controller 20 delivers fuel to the cylinders 22 at block 134 based on the allocation determination at block 132. As fuel is delivered to the cylinders 22, the controller 20 measures the pressure of the engine system 10 at block 136. This pressure measurement is sent to the unit 138 and is used in conjunction with the pressure command value 114 from the engine 12 to determine the pressure error value 112, thereby restarting the steps of the method 100. That is, after a predetermined period of time, the method 100 is configured to remeasure the pressure of the engine system 10 at block 134, which is used to calculate the pressure error value 112. After the pressure error value 112 is calculated, the method 100 is repeated.

In another embodiment, iterations of the method 100 can be performed based on pump event occurrences. For example, once the fuel allocation is delivered to a single pump of the engine subcycle, the pressure of the engine system 10 is measured at block 134, which is used to calculate the pressure error value 112. The method 100 then repeats. For example, referring again to FIG. 5, once pump event i occurs, the method 100 measures the pressure of the engine 12 at block 136 and calculates the pressure error value 112. The method 100 then repeats by performing a subcycle mass balance calculation 126, which includes the subsequent pressure error value 112. The minimum repeatable subcycle may shift such that the minimum repeatable subcycle includes pump events ii-v and cylinder events II-IV (four pump events and three cylinder events) when calculating the subcycle mass balance 126. Once the method 100 is completed and a cylinder event II occurs at a pump cylinder, the minimum repeatable subcycle may shift such that the minimum repeatable subcycle includes pump events iii-vi and cylinder events III-V (four pump events and three cylinder events) when calculating the subsequent subcycle mass balance 126. This process iterates for the duration of engine operation.

The iterative nature of the method 100 provides for granular control of the engine cylinders. In other words, the iterative method 100 enables the engine system 10 to be more responsive to changes in engine operation by continuously updating the fuel needed for current engine operation.

The description herein including modules emphasizes the structural independence of the aspects of the controller 20 and illustrates one grouping of operations and responsibilities of the controller 20. Other groupings that execute similar overall operations are understood within the scope of the present application. Modules may be implemented in hardware and/or software on computer readable medium, and modules may be distributed across various hardware or software components. Additionally, the controller 20 need not include all of the modules discussed herein.

As such, various modifications and additions can be made to the exemplary embodiments discussed without departing form the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A method of controlling fuel pressure within an engine system, the method comprising:

providing an engine system comprising at least one pump, a controller, and an engine comprising at least one cylinder calculating a ratio of cylinder events to pump events for an engine cycle to determine a minimum repeatable subcycle;

performing a subcycle mass balance calculation on the engine system to calculate a total subcycle delivery demand of fuel;

allocating the total subcycle delivery demand to each of the pump events; and delivering fuel to the engine system;

wherein a cylinder event includes all injection events per cylinder in an engine cycle; and wherein a pump event is the total cycle duration during which a single pumping element of the engine system can deliver all of its swept volume or mass.

2. The method of claim 1, further comprising:

receiving a pressure command value;

measuring a pressure feedback value of the engine system; and calculating a pressure error for use in the subcycle mass balance calculation.

3. The method of claim 2, further comprising:

performing a second subcycle mass balance calculation on the engine system to calculate a second total subcycle delivery demand of fuel, wherein the second subcycle mass balance calculation includes the pressure error value; and allocating the second total subcycle delivery demand of fuel to each pump event.

4. The method of claim 2, further comprising:

transmitting the pressure error to a PID controller, wherein the PID controller applies a proportional integral derivative to the pressure error value and communicates a control signal for the subcycle mass balance calculation.

5. The method of claim 1, further comprising:

limiting the total subcycle delivery demand of fuel by a subcycle maximum delivery quantity of fuel;

wherein a fuel amount corresponding to the subcycle maximum delivery quantity of fuel is delivered when the total subcycle delivery demand of fuel is greater than or equal to the subcycle maximum delivery quantity of fuel; and wherein a fuel amount corresponding to the total subcycle delivery demand is delivered when the total subcycle delivery demand of fuel is less than the subcycle maximum delivery quantity of fuel and greater than 0.

6. The method of claim 1, wherein the subcycle mass balance calculation includes an integer of the cylinder events of the minimum repeatable subcycle, an engine fuel demand per cylinder, other mass effects, and a pressure error value.

7. The method of claim 6, wherein the engine fuel demand per cylinder is the amount of fuel needed by the engine system under current operating conditions divided by a number of engine cylinders in the engine system;

wherein the at least one mass effect comprises leakage within the engine system; and wherein the pressure error value comprises the difference between a pressure feedback value from the engine system and pressure command value.

8. The method of claim 1, wherein delivering the fuel to the engine system comprises delivering the fuel to a single cylinder.

9. A method of controlling fuel pressure with an engine system, the method comprising:

calculating a ratio of cylinder events to pump event for an engine cycle to determine a minimum repeatable subcycle;

performing a subcycle mass balance calculation on the engine system to determine a total subcycle delivery demand of fuel;

limiting the total subcycle delivery demand of fuel by a subcycle maximum delivery quantity of fuel;

allocating the total subcycle delivery demand of fuel or the subcycle maximum delivery quantity of fuel to each pump event;

delivering the fuel to the engine system;

wherein delivering the fuel to the engine system includes delivering fuel to at least one pump of the engine system;

measuring a pressure feedback value of the engine system;

calculating a pressure error value from the measured pressure feedback value; and including the pressure error value in the subcycle mass balance calculation:

wherein a cylinder event includes all injection events per cylinder in an engine cycle; and wherein a pump event is the total cycle duration during which a single pumping element of the engine system can deliver all of its swept volume or mass.

10. The method of claim 9, wherein the step of limiting the total subcycle delivery demand of fuel, by the subcycle maximum delivery quantity of fuel comprises:

delivering the subcycle maximum delivery quantity of fuel when the total subcycle delivery demand of fuel is greater than or equal to the subcycle maximum delivery quantity of fuel; and delivering the total subcycle delivery demand of fuel when the total subcycle delivery demand of fuel is less than the subcycle maximum delivery quantity of fuel and greater than 0.

11. The method of claim 9, wherein measuring the pressure feedback value of the engine system includes measuring the pressure feedback value in response to fuel delivery to at least one pump of the engine system.

12. The method of claim 9, further comprising:

calculating a second subcycle mass balance that incorporates the pressure error value to determine a second total subcycle delivery demand of fuel;

limiting the second total subcycle delivery demand of fuel by a subcycle delivery quantity of fuel;

allocating the second total subcycle delivery demand of fuel or the subcycle delivery quantity of fuel to each pump event; and delivering the fuel to the engine system;

wherein delivering the fuel to the engine system includes delivering fuel to at least one pump of the engine system.

13. The method of claim 12, further comprising:

limiting the total subcycle delivery demand of fuel by a subcycle maximum delivery quantity of fuel;

wherein a fuel amount corresponding to the subcycle maximum delivery quantity of fuel is delivered when the total subcycle delivery demand of fuel is greater than or equal to the subcycle maximum delivery quantity of fuel; and wherein a fuel amount corresponding to the total subcycle delivery demand of fuel is delivered when the total subcycle delivery demand of fuel is less than the subcycle maximum delivery quantity of fuel and greater than 0.

14. The method of claim 9, wherein the subcycle mass balance calculation includes an integer of the cylinder events of the minimum repeatable subcycle, an engine fuel demand per cylinder, at least one mass effect, and a pressure error value.

15. The method of claim 14, wherein the engine fuel demand per cylinder is the amount of fuel needed by the engine system under current operating conditions divided by a number of engine cylinders in the engine system;

wherein the at least one mass effect comprises leakage within the engine system; and wherein the pressure error value comprises the difference between a pressure feedback value from the engine system and a pressure command value.

* * * * *